US005477247A

United States Patent [19]

Kanegae

[11] Patent Number: 5,477,247

[45] Date of Patent: Dec. 19, 1995

[54] INK DROPLET JET DEVICE

[75] Inventor: Takahiro Kanegae, Tokai, Japan

[73] Assignee: Brother Kogyo Kabushiki Kaisha, Nagoya, Japan

[21] Appl. No.: 186,158

[22] Filed: Jan. 25, 1994

[30] Foreign Application Priority Data

Feb. 25, 1993 [JP] Japan ..... 5-36313
Dec. 2, 1993 [JP] Japan ..... 5-302525

[51] Int. Cl.[6] ..... B41J 2/045

[52] U.S. Cl. ..... 347/20; 347/71

[58] Field of Search ..... 347/68, 69, 71, 347/44, 47, 20; 310/328, 333; 29/25.35

[56] References Cited

U.S. PATENT DOCUMENTS

| | | | |
|---|---|---|---|
| 4,730,197 | 3/1988 | Raman et al. | 347/71 |
| 4,879,568 | 11/1989 | Bartky et al. | 347/69 |
| 4,887,100 | 12/1989 | Michaelis et al. | 347/69 |
| 4,992,808 | 2/1991 | Bartky et al. | 347/69 |
| 5,003,679 | 4/1991 | Bartky et al. | 29/25.35 |
| 5,016,028 | 5/1991 | Temple | 347/69 |
| 5,028,936 | 7/1991 | Bartky et al. | 347/69 |

FOREIGN PATENT DOCUMENTS

| | | |
|---|---|---|
| 0485241A1 | 5/1992 | European Pat. Off. . |
| 0528648A1 | 2/1993 | European Pat. Off. . |
| 0535772A2 | 4/1993 | European Pat. Off. . |
| 4-45945 | 2/1992 | Japan . |
| 4-94942 | 3/1992 | Japan . |

*Primary Examiner*—Benjamin R. Fuller
*Assistant Examiner*—Alrick Bobb
*Attorney, Agent, or Firm*—Oliff & Berridge

[57] ABSTRACT

An ink droplet jet device in which the volume of the ink channels is varied by deformation of the side walls due to piezoelectric thickness shear mode to thereby jet an ink droplet requires sufficient volume variation of the ink channels to function reliably. To satisfy this requirement, the material and thickness of an adhesive agent used to secure the piezoelectric plate to the cover plate is selected so that the value obtained by dividing Young's modulus of adhesive agent for adherence between the upper surface of the side wall of the piezoelectric plate and the cover plate by the thickness of the adhesive agent is above $5\times10^3$ kg/mm$^3$, preferably $5\times10^4$ kg/mm$^3$, and more preferably above $1.2\times10^5$ kg/mm$^3$. Further, the material and thickness of the adhesive agent is selected so that the value obtained by dividing Young's modulus of the adhesive agent for adherence between the end surface of the side wall and the nozzle plate by the thickness of the adhesive agent is below $1\times10^6$ kg/mm$^3$, preferably $5\times10^5$ kg/mm$^3$, and more preferably $3\times10^5$ kg/mm$^3$. By these settings, the jet velocity of the ink droplet is above a predetermined value, and stable ink droplet jetting can be performed.

19 Claims, 8 Drawing Sheets

INK DROPLET JET DEVICE

BACKGROUND OF THE INVENTION

1. Field of the Invention

This invention relates to an ink droplet jet device capable of stably jetting ink droplets at all times.

2. Description of the Related Art

Conventionally, a drop on-demand ink droplet jet device uses a piezoelectric ceramic element. This device is designed such that the volume of an ink channel is varied to jet ink in the ink channel through a nozzle when the volume of the channel is reduced and to introduce ink into the ink channel through an ink inlet port when the volume of the channel is increased. In this device, ink is jetted from a jetting device at a predetermined position according to print data to form desired characters or images.

Such an ink droplet jet device is disclosed in U.S. Pat. No. 5,016,028. The construction of this ink droplet jet device is described below.

As shown in FIG. 3, an ink jet printer head 1 comprises a piezoelectric ceramic plate 2, a cover plate 3, a nozzle plate 31, and a base plate 41.

The piezoelectric ceramic plate 2 is formed with plural grooves 8 by cutting the plate 2 with a thin disk-shaped diamond blade or the like. A side wall 11, which serves as a side surface for the grooves 8, is polarized in a direction as indicated by an arrow 5. These grooves 8 are designed to have the same depth and to be arranged in parallel to one another. The depth of the grooves 8 gradually decreases and becomes more shallow toward one end surface 15 of the piezoelectric ceramic plate 2 to form shallow grooves 16 near the end surface 15. Further, metal electrodes 13 are formed at upper half portions of both side surfaces of the inner surface of each groove 8 by a sputtering method or the like. In addition, metal electrodes 9 are formed at the side surfaces and the bottom surface of the inner surface of each shallow groove 16 by the sputtering method or the like. With this construction, the metal electrodes 13 formed at both side surfaces of the groove 8 are linked to the metal electrodes 9 formed at the shallow groove 16.

The cover plate 3 is formed of ceramic material or resin material. An ink inlet port 21 and a manifold 22 are formed in the cover plate 3 by polishing or cutting. The surface at the worked side of the groove 8 of the piezoelectric ceramic plate 2 and the surface at the worked side of the manifold 22 of the cover plate 3 are adhesively attached to each other through an adhesive agent from the epoxy group or the like (see FIG. 6). Accordingly, in the ink jet printer head 1, the grooves 8 are covered at the upper surfaces thereof to form plural ink channels 12 (FIG. 6) that are arranged in a lateral direction spaced from each other.

As shown in FIG. 3, a nozzle plate 31 provided with nozzles 32 at positions corresponding to the positions of the respective ink channels 12 is adhesively attached to the end surfaces of the piezoelectric ceramic plate 2 and the cover plate 3 through adhesive agent 33 from the epoxy group (see FIG. 4). This nozzle plate 31 is formed of plastic such as polyalkylene (for example, ethylene) terephthalate, polyimide, polyetherimide, polyetherketone, polyethersulfone, polycarbonate, cellulose acetate or the like.

The base plate 41 is adhesively attached to the surface of the piezoelectric ceramic plate 2, which is opposite to the worked side surface of the grooves 8, by an adhesive agent from the epoxy group (not shown). The base plate 41 is formed with conductive layer patterns 42 at the positions corresponding to the respective ink channels 12. The conductive layer patterns 42 and the metal electrodes 9 at the bottom surface of the shallow grooves 16 are connected to each other through conductive wiring 43 by a wire bonding method or the like.

Next, the construction of a control unit is described with reference to FIG. 5 showing a block diagram for the control unit. The conductive patterns 42 formed on the base plate 41 are individually connected to an LSI chip 51. Further a clock line 52, a data line 53, a piezoelectric line 54 and a ground line 55 are also connected to the LSI chip 51. On the basis of continuous clock pulses supplied from the clock line 52, the LSI chip 51 determines those nozzles 32 from which the ink droplet should be jetted according to data appearing on the data line 53. On the basis of this determination, a voltage V of the voltage line 54 is applied to the conductive layer patterns 42 conductively connected to the metal electrodes 13 of the ink channels 12 to be driven. Also, a voltage of 0 V of the ground line 55 is applied to the conductive layer pattern 42 conductively connected to the metal electrodes 13 other than the metal electrodes of the ink channels 12 to be driven.

Next, the operation of the ink jet printer head 1 is described referring to FIGS. 5 and 6. The LSI chip 51 determines that the ink should be jetted from the ink channel 12B of the ink jet printer head 1 based on print data. Upon this determination, a positive driving voltage V is applied to the metal electrodes 13E and 13F, and the metal electrodes 13D and 13G are grounded. As shown in FIG. 7, a driving electric field in the direction of arrow 14B occurs in the side wall 11B and a driving electric field in the direction of arrow 14C occurs in the side wall 11C. In this case, since both of the directions of the driving electric fields 14B and 14C are perpendicular to the polarization direction 5, the side walls 11B and 11C are rapidly deformed toward the inside of the ink channel 12B by piezoelectric thickness shear mode. This deformation causes the volume of the ink channel 12B to decrease and ink pressure to rapidly increase. Accordingly, a pressure wave is generated, which causes the jetting of the ink droplet from the nozzle 32 (FIG. 3) that is intercommunicated with the ink channel 12B.

Upon termination of the application of the driving voltage V, the side walls 11B and 11C gradually return to their initial positions before deformation (see FIG. 6), so that the ink pressure in the ink channel 12B is gradually reduced. This causes the ink to be supplied from the ink inlet port 21 (FIG. 3) through the manifold 22 (FIG. 3) into the ink channel 12B.

In the conventional ink droplet jet device as described above, sufficient volume variation is required for the ink channels 12 because the volume of the ink channels 12 is varied to jet ink droplets by the deformation of the side walls due to the piezoelectric thickness shear mode. To satisfy this requirement, as shown in FIG. 8, the upper surfaces of the side walls 11 and the cover plate 3 must be completely fixed to each other by the adhesive agent 4. That is, if the agent 4 has a small Young's modulus or has a thick adhesive layer, so that the elasticity of the adhesive layer of the agent layer 4 is large and its rigidity is small, then the adhesive agent 4 would be deformed in the direction opposite to the deformation direction of the side walls 11 as shown in FIG. 9. In this case, insufficient volume variation of the ink channels 12 occurs and a desired jet velocity of the ink droplet is not obtained. Further, solving this problem also causes a problem in the elasticity of the agent 33 for adhesively fixing the nozzle plate 31, the piezoelectric ceramic plate 2 and the cover plate 3. That is, if the adhesive agent has small elasticity, that is, a large rigidity, the end surfaces of the side walls 11 and the nozzle plate 31 will be firmly fixed. Thus, the volume variation of the ink channels 12 by the piezoelectric thickness shear mode of the side walls 11 will not be sufficiently carried out. In this case, the jetting of the ink droplet is adversely affected, and a desired jet velocity of the ink droplet cannot be obtained or no ink droplet is jetted.

SUMMARY OF THE INVENTION

An object of the present invention is to provide an ink droplet jet device capable of stably jetting an ink droplet at all times.

To attain the above and other objects, according to this invention, an ink droplet jet device is provided that has a piezoelectric ceramic plate with plural grooves and a cover plate adhesively attached by an adhesive agent to upper surfaces of walls serving as the side surfaces of the grooves forming the ink channels. In this assembly, the volume of the ink channels is varied by deformation of the walls to eject ink from the ink channels. The adhesive agent is chosen so that a value obtained by dividing Young's modulus of the adhesive agent by the thickness of the adhesive layer of the adhesive agent is set to $5\times10^3$ kg/mm$^3$ or more.

Preferably, the value obtained by dividing the Young's modulus of the adhesive agent by the thickness of the adhesive layer is set to $5\times10^4$ kg/mm$^3$ or more. More preferably, the value obtained by dividing the Young's modulus of the adhesive agent by the thickness of the adhesive layer is set to $1.2\times10^5$ kg/mm$^3$ or more.

Further, an ink droplet jet device has a channel member formed with ink channels with open end portions and a nozzle plate adhesively attached to the end portions of the channel member by an adhesive agent and formed with nozzles so that the nozzles communicate with the ink channels. The volume of the ink channels is varied by deformation of the walls of the ink channels to thereby jet ink filled in the ink channels. A value obtained by dividing Young's modulus of the adhesive agent for adhering of the nozzle plate by the thickness of the adhesive layer of the adhesive agent is set to $1\times10^6$ kg/mm$^3$ or less.

Preferably, the value obtained by dividing the Young's modulus of the adhesive agent by the thickness of the adhesive layer is set to $5\times10^5$ kg/mm$^3$ or less. More preferably, the value obtained by dividing the Young's modulus of the adhesive agent by the thickness of the adhesive layer is set to $3\times10^5$ kg/mm$^3$ or less.

According to the ink droplet jet device according to this invention thus constructed, the value obtained by dividing the Young's modulus of the adhesive agent for adhering the cover plate by the thickness of the adhesive layer of the adhesive agent is set to $5\times10^3$ kg/mm$^3$ or more. Thereby, the desired rigidity in the adhesive layer can be achieved, and thus the volume variation of the ink channels due to the deformation of the walls can be performed by a prescribed variation amount. Further, in this ink droplet jet device, the value obtained by dividing the Young's modulus of the adhesive agent for adhering the nozzle plate by the thickness of the adhesive layer of the adhesive agent is set to $1\times10^6$ kg/mm$^3$ or less. Thereby, the desired elasticity in the adhesive layer can be achieved, and thus the volume variation of the ink channels due to the deformation of the walls can be performed by a prescribed variation amount.

As is apparent from the foregoing, in the ink droplet jet device of this invention, the value obtained by dividing the Young's modulus of the adhesive agent, which is used for the adherence between the cover plate and the upper surface of the wall serving as the side surface of the groove of the piezoelectric ceramic plate, by the thickness of the adhesive layer of the adhesive agent is set to $5\times10^3$ kg/mm$^3$ or more. So, sufficient volume variation of the ink channels can be obtained by the deformation of the wall, and stable ink jetting can be performed.

Further, in the ink droplet jet device of this invention, the value obtained by dividing the Young's modulus of the adhesive agent, which is used for the adherence between the end portion of the channel member forming the ink channels and the nozzle plate, by the thickness of the adhesive layer of the adhesive agent is set to $1\times10^6$ kg/mm$^3$ or less. So, the sufficient volume variation of the ink channels can be obtained by the deformation of the walls of the ink channels, and, thus, stable ink jetting can be performed.

DETAILED DESCRIPTION OF PREFERRED EMBODIMENTS

Figure 1:
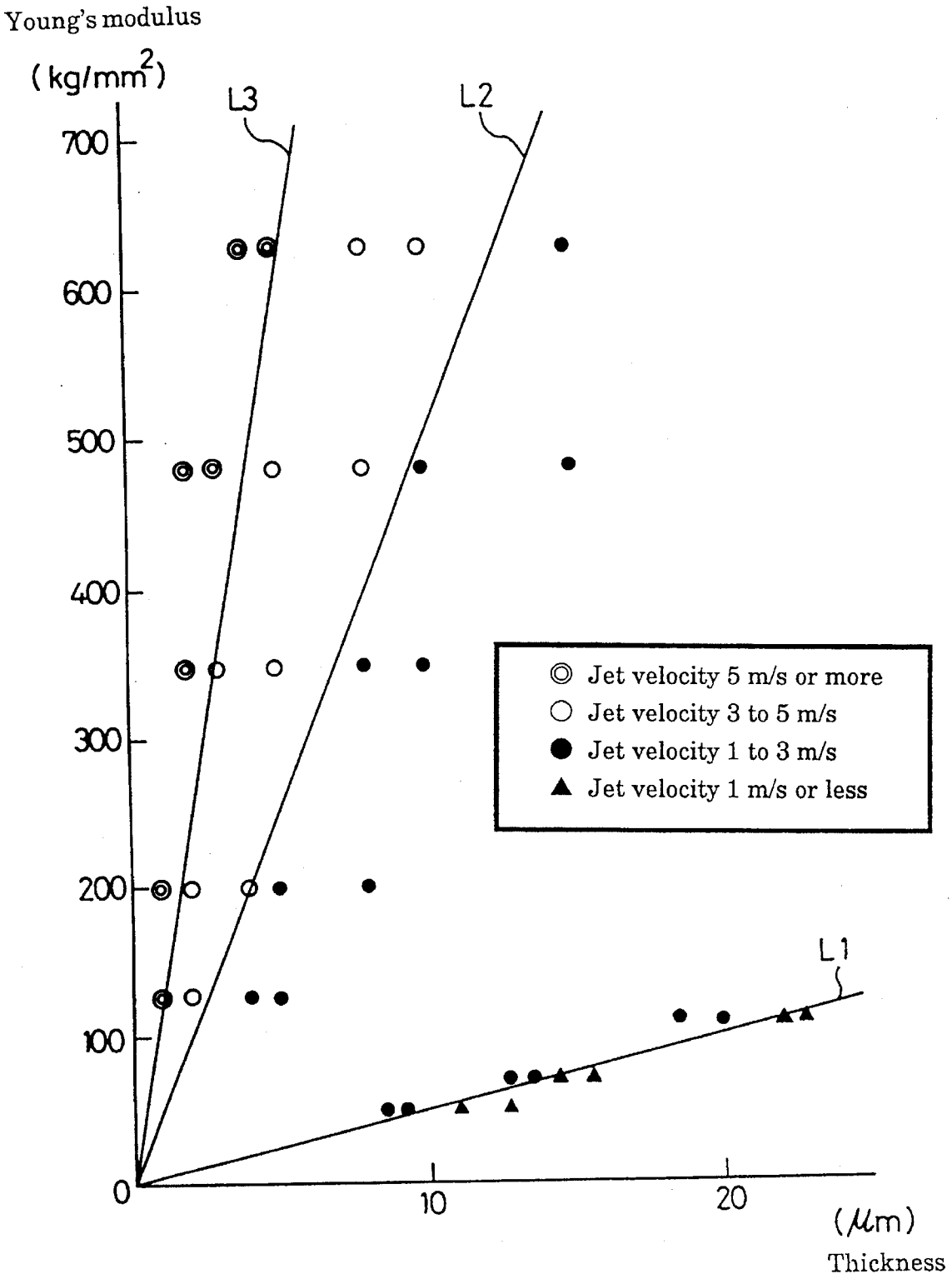
FIG. 1 is a graph showing the relationship between Young's modulus of the adhesive agent, which is used for the adherence between the piezoelectric ceramic plate and the cover plate, and the thickness of the adhesive layer in an embodiment of the invention.

This invention is described in detail with reference to the drawings. For convenience, the elements the same as and equivalent to elements in the prior art are represented by the same reference numerals, and the detailed description thereof is omitted.

Figure 4:
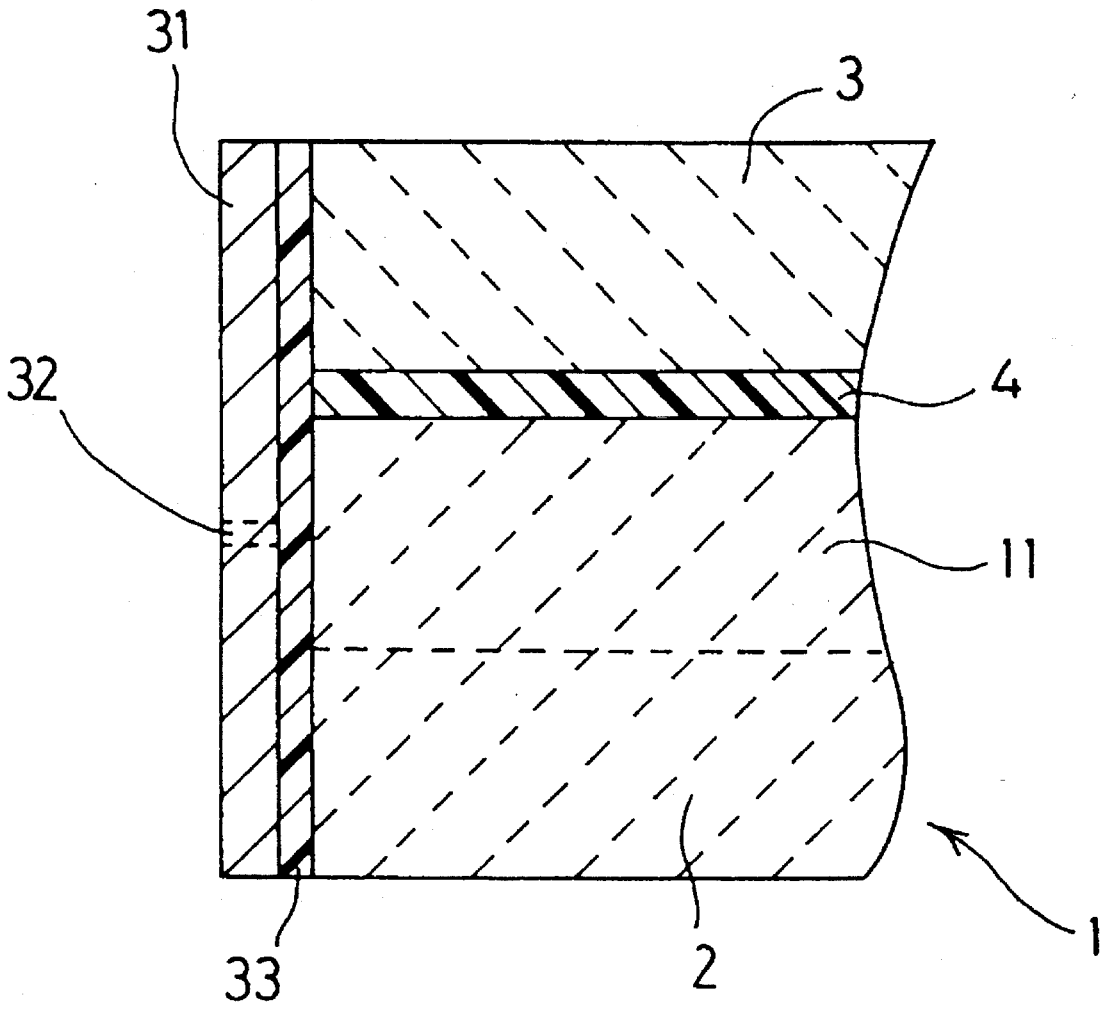
FIG. 4 is a cross-sectional view of the ink jet printer head of the preferred embodiment and the prior art, which is cut in a flow direction of ink channels.
Figure 5:
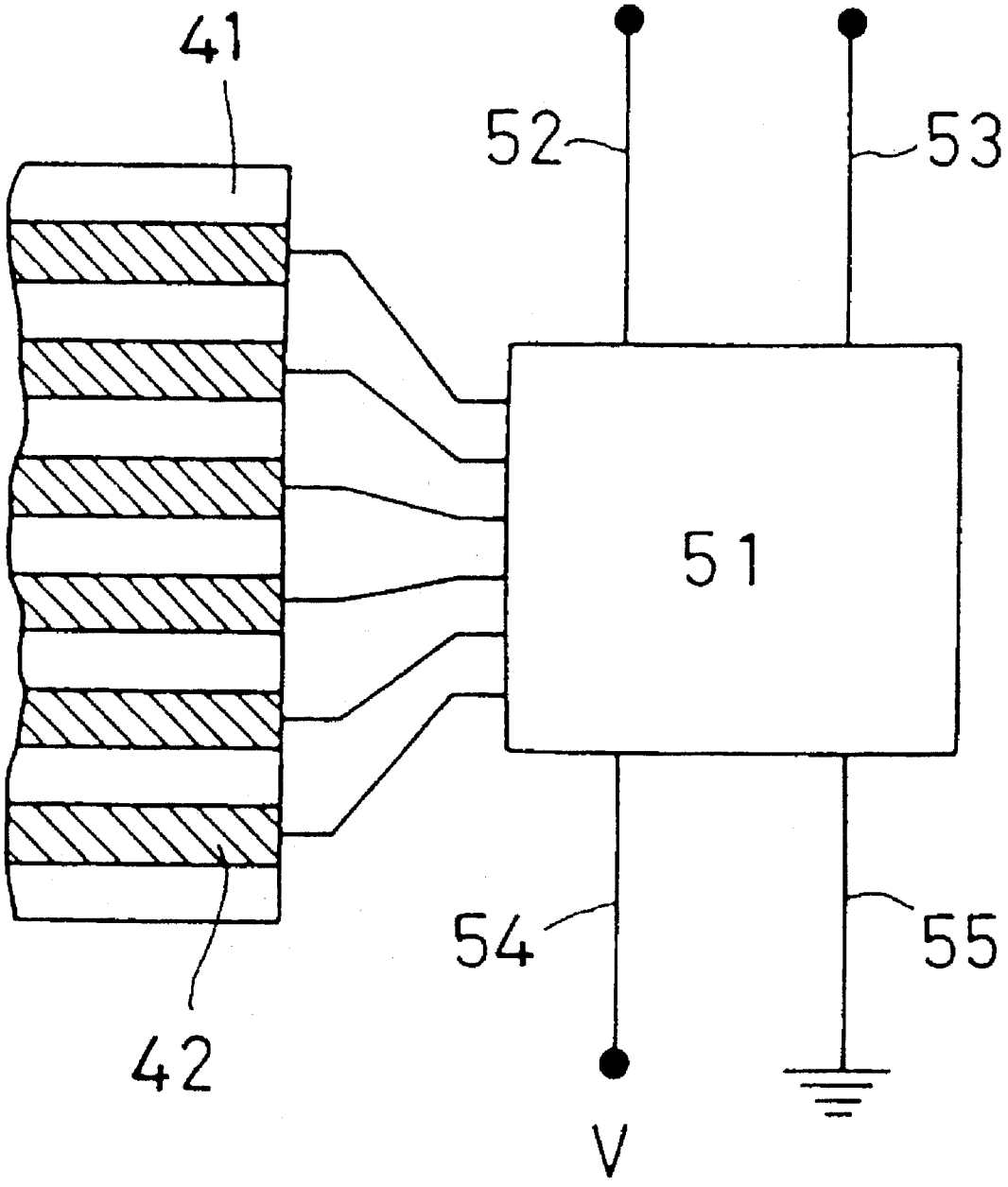
FIG. 5 is an explanatory diagram showing a control unit of the ink jet printer head of the preferred embodiment and the prior art.
Figure 6:
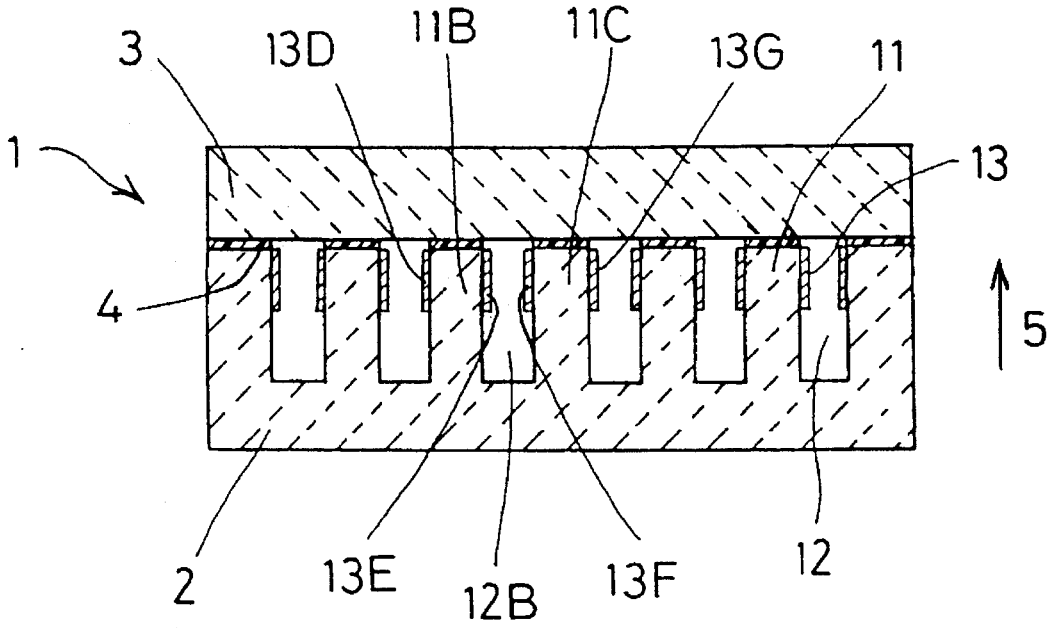
FIG. 6 is a front cross-sectional view showing the construction of the ink jet printer head of the preferred embodiment and the prior art.
Figure 7:
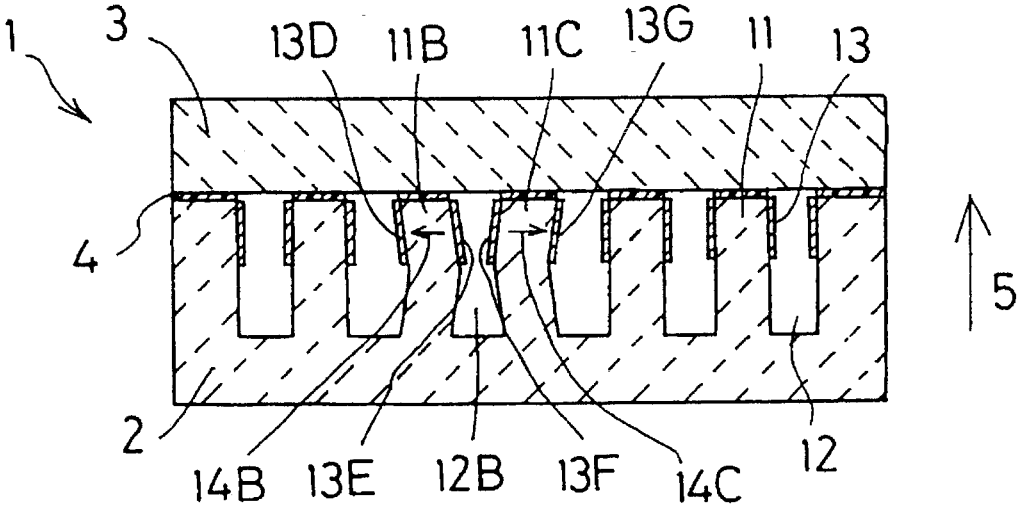
FIG. 7 is a front cross-sectional view of the device in FIG. 5 in an operational state.
Figure 8:
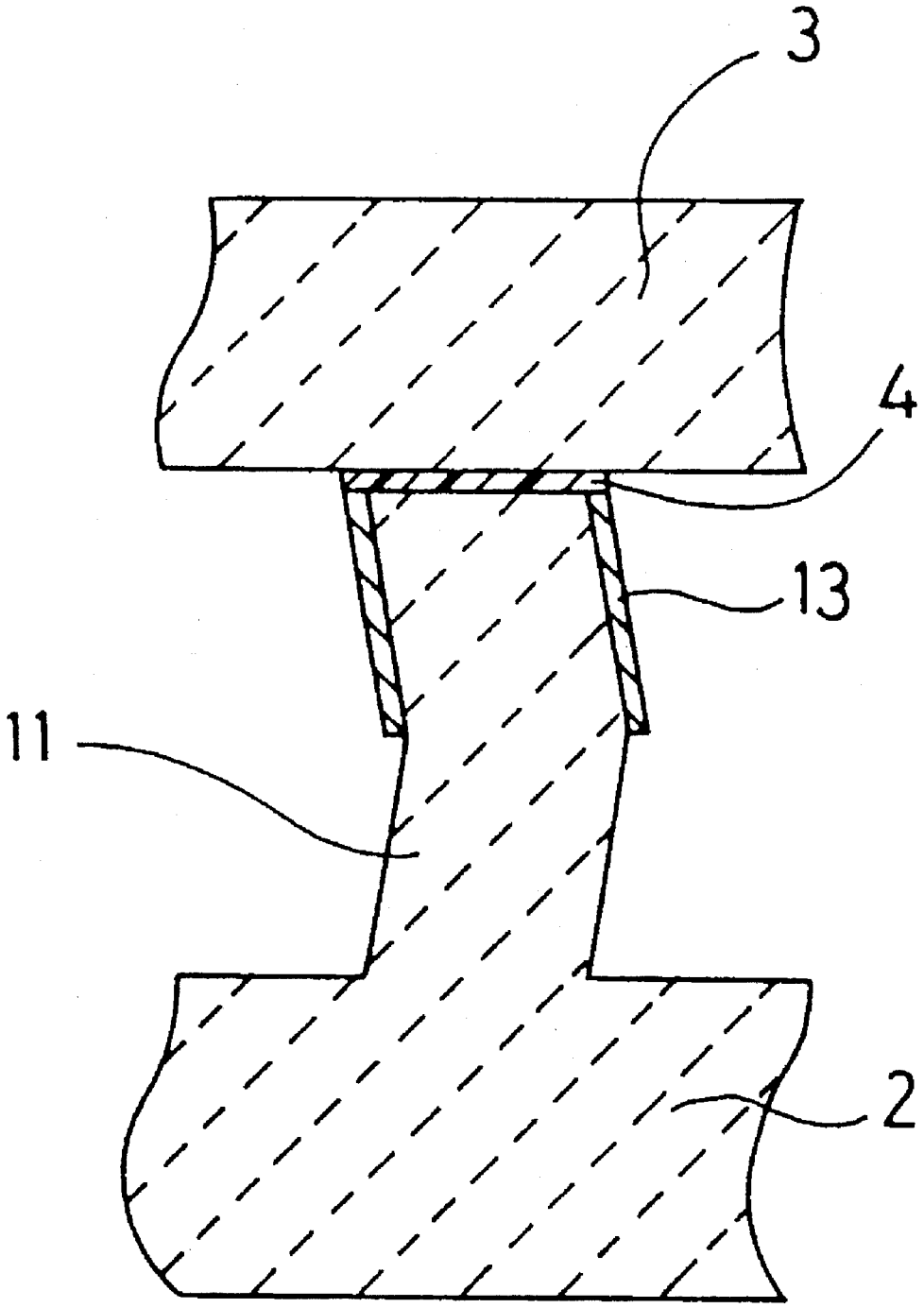
FIG. 8 is an enlarged partial view of the device of FIG. 6 in an operational state similar to FIG. 7 specifically showing the adhesive layer between the side wall of the ink jet printer head and the cover plate at the piezoelectric thickness shear mode of the side wall of ink jet printer head.
Figure 9:
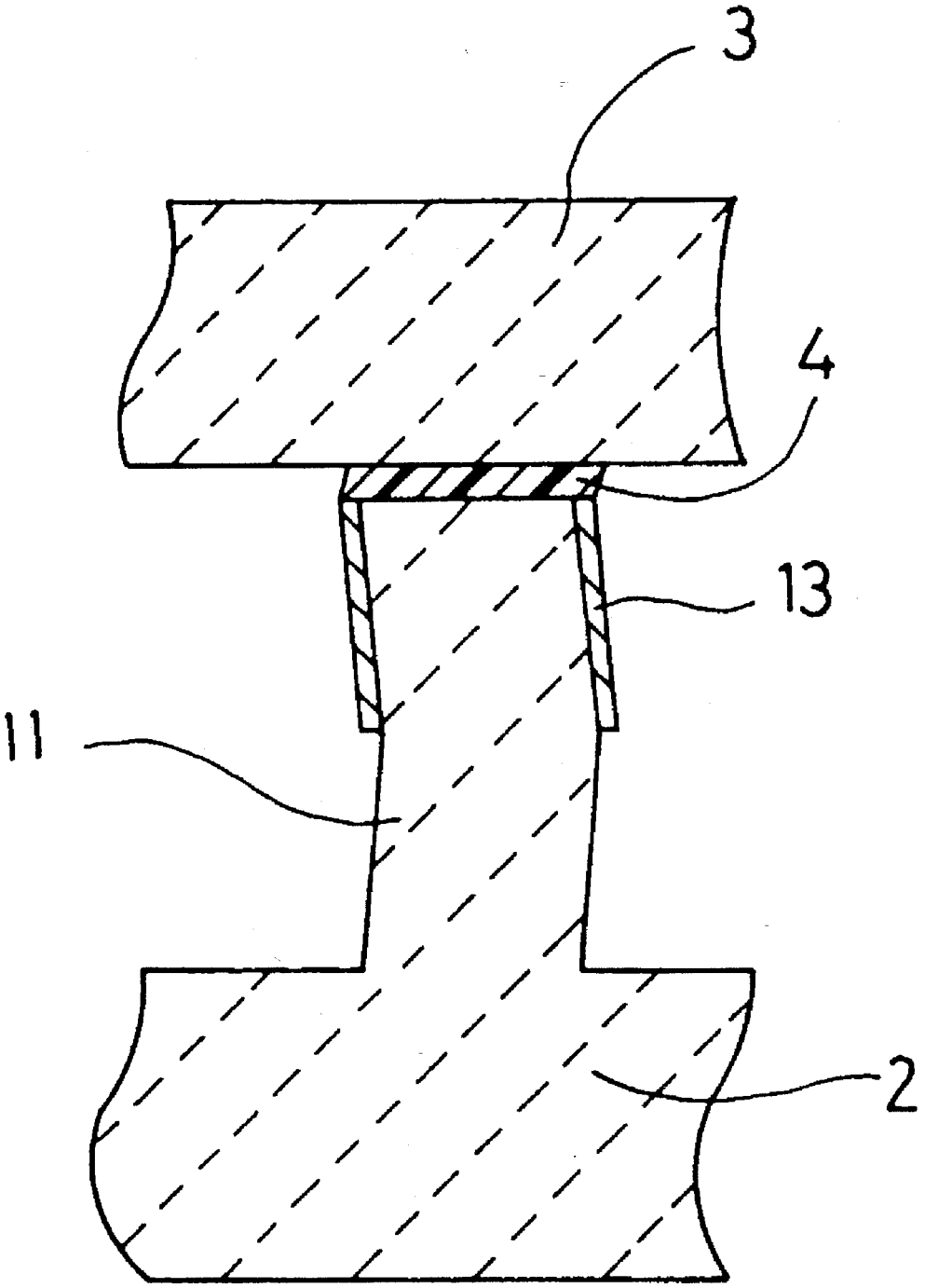
FIG. 9 is an enlarged partial view similar to FIG. 8 showing the adhesive layer at the piezoelectric thickness shear mode of the side wall when the adhesive layer between the side wall of the ink jet printer head and the cover plate has large elasticity.

FIGS. 4 and 6 show the adhesive agent 4 through which the upper surface of the side wall 11 of the piezoelectric ceramic plate 2 adheres to the cover plate 3. As described above, if the Young's modulus of the adhesive agent 4 is small or the adhesive layer of the adhesive agent 4 is thick, and thus the adhesive layer of the adhesive agent 4 has large elasticity, that is, small rigidity, the adhesive agent 4 is deformed in the direction opposite to the deformation direction of the side wall 11 as shown in FIG. 9. So, sufficient volume variation of the ink channels 12 is not obtained.

In view of the above, using plural adhesive agents 4 of an epoxy group having different Young's moduli (after hardening), an ink droplet experiment of the ink jet printer head 1 was performed for the respective adhesive agents 4 while varying the thickness of the adhesive layer. For the adhesive agents 4 used in the experiment, Young's modulus after hardening is an important factor, and the other characteristics are not a necessary consideration in this experiment. The experiment's result is shown in FIG. 1. The thickness of the adhesive layer of the adhesive agent 4 was measured by a microscope in the experiment. The effectiveness of the ink jet printer head 1 was estimated by measuring jet velocity of an ink droplet because the jet velocity of the ink droplet is proportional to volume variation of the ink channels 12.

The jet velocity of the ink droplet and stability of the ink jetting is described on the basis of a rule of thumb by the experiment. For jet velocity less than 1 m/s, no ink is jetted (an ink droplet is not separated), or, even if ink is jetted, the ink droplet does not adhere to a desired position due to air flow or the like in a gap between the nozzle 32 and the sheet, so that print quality is deteriorated. Accordingly, to produce ink droplet jet devices for the market, the jet velocity must be set to 1 m/s or more.

Further, the ink jet velocity can affect the ink droplet jet device in the following ways. First, when the nozzle has non-uniform shape or dust or ink adheres near the nozzle, linearity of jetting of the ink is affected if the jet velocity is small. Moreover, in a carriage scanning type of ink droplet jet device, the carriage movement causes air flow to be severe in a gap between the nozzle 32 and the sheet, and the impact point of the ink is liable to deviate with a small jet velocity. This deviation is more remarkable when the carriage moving speed is increased for high speed printing or when the distance between the nozzle and a platen is large to enable the printing on a thick sheet.

Accordingly, when the conditions described above are considered, in order to realize stable jetting, the jet velocity must be preferably set to 3 m/s or more. If the jet velocity is set to 5 m/s or more, stable jetting can be realized irrespective of the conditions described above.

In consideration of the above matters, the effectiveness of the ink jet printer head as shown in FIG. 1 was estimated by sectioning the jet velocity into 5 m/s or more, 3 to 5 m/s, 1 to 3 m/s, and 1 m/s or less.

As is apparent from FIG. 1, the jet velocity of the ink droplet is above 5 m/s in an upper area of the line L3, 3 to 5 m/s in an area between the lines L3 and L2, 1 to 3 m/s in an area between the lines L2 and L1, and 1 m/s or less in a lower area of the line L1. Here, the inclination of each of the lines L1, L2 and L3 corresponds to a value obtained by dividing Young's modulus of the adhesive agent 4 by the thickness of the adhesive agent 4, and these values for the lines are $5\times10^3$ kg/mm$^3$, $5\times10^4$ kg/mm$^3$ and $1.2\times10^5$ kg/mm$^3$. Accordingly, if the value obtained by dividing the Young's modulus of the adhesive agent 4 by the thickness of the adhesive agent 4 is above $5\times10^3$ kg/mm$^3$, preferably above $5\times10^4$ kg/mm$^3$, and more preferably above $1.2\times10^5$ kg/mm$^3$, stable jetting of the ink droplet can be performed. Here, on the basis of the above result, the adhesive layer is preferably thinner because its rigidity is increased. However, it must be designed to have such a thickness that the cover plate 3 and the upper surface of the side wall 11 are completely coupled to each other. Also, technical limitations are imposed on the thinning of the adhesive layer. Accordingly, when the adhesive layer is designed to be thick, an adhesive agent having a large Young's modulus in accordance with a required jet velocity may be used.

As described above, if the material and thickness of the adhesive agent are selected so that the value obtained by dividing the Young's modulus of the adhesive agent 4 for adherence between the upper surface of the side wall 11 of the piezoelectric ceramic plate 2 and the cover plate 3 by the thickness of the adhesive agent 4 is set to $5\times10^3$ kg/mm$^3$ or more, preferably $5\times10^4$ kg/mm$^3$ or more, and more preferably $1.2\times10^5$ kg/mm$^3$ or more, sufficient volume variation of the ink channels 12 can be obtained by the deformation of the side walls 11 due to the piezoelectric thickness shear mode. Thus, the ink droplet jetting can be stably performed.

Next, the adhesive agent 33 (see FIG. 4) for adhesively attaching the nozzle plate 31 to the end surfaces of the piezoelectric ceramic plate 2 and the cover plate 3 is described.

Figure 3:
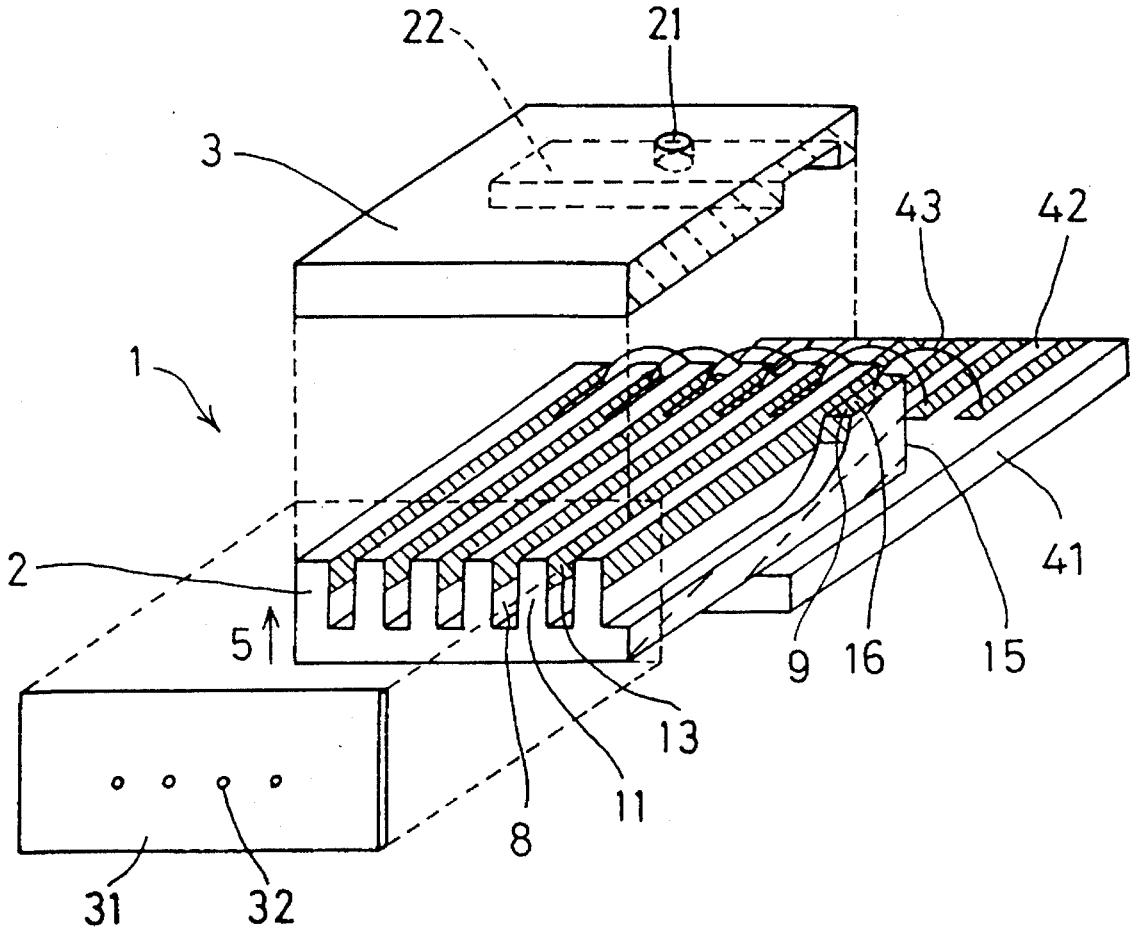
FIG. 3 is an exploded perspective view showing the construction of an ink jet printer head of the preferred embodiment and the prior art.

As shown in FIG. 4, the adhesive agent 33 is provided between the end surface of the piezoelectric ceramic plate 2 constituting the side wall 11 and the nozzle plate 31. No adhesive agent 33 is provided between the ink channels 12 (FIG. 3) communicated with the nozzles 32 and the nozzle plate 31. In general, the nozzle plate 31 is preferably formed of resin or metal material in deferrance to the formation of the nozzles 32 or the like. Thus, the nozzle plate 31 has a different coefficient of linear expansion from the piezoelectric ceramic plate 2 formed of ceramic material. Accordingly, the adhesive agent 33 for adherence between the piezoelectric ceramic plate 2 and the nozzle plate 31 must be designed to have some degree of elasticity to accommodate the difference between the coefficients of linear expansion of the piezoelectric ceramic plate 2 and the nozzle plate 31. Further, if the adhesive agent 33 has a small elasticity, that is, has a large rigidity, and the end surface of the side wall 11 and the nozzle plate 31 are fixed to each other, the volume variation of the ink channels 12 due to the piezoelectric thickness shear mode cannot be sufficiently performed. So, ink droplet jetting is adversely affected.

In view of the above, an experiment was performed using plural adhesive agents 33 of an epoxy group having different Young's modulus (after hardening), while varying the thickness of the adhesive layer. For the adhesive agent 33 used in the experiment, Young's modulus after hardening is important. Thus, the other characteristics were not considered in this experiment. Further, the effectiveness of the ink jet printer head 1 was estimated by measuring the jet velocity of the ink droplet. For the reasons described above, the estimation was made by sectioning the jet velocity of the ink droplet into 5 m/s or more, 3 to 5 m/s, 1 to 3 m/s and 1 m/s or less. The thickness of the adhesive agent 33 was measured with a microscope by cutting the ink jet printer head 1 in the direction of the ink channels 12 after the jetting experiment. The experiment's result is shown in FIG. 2.

Figure 2:
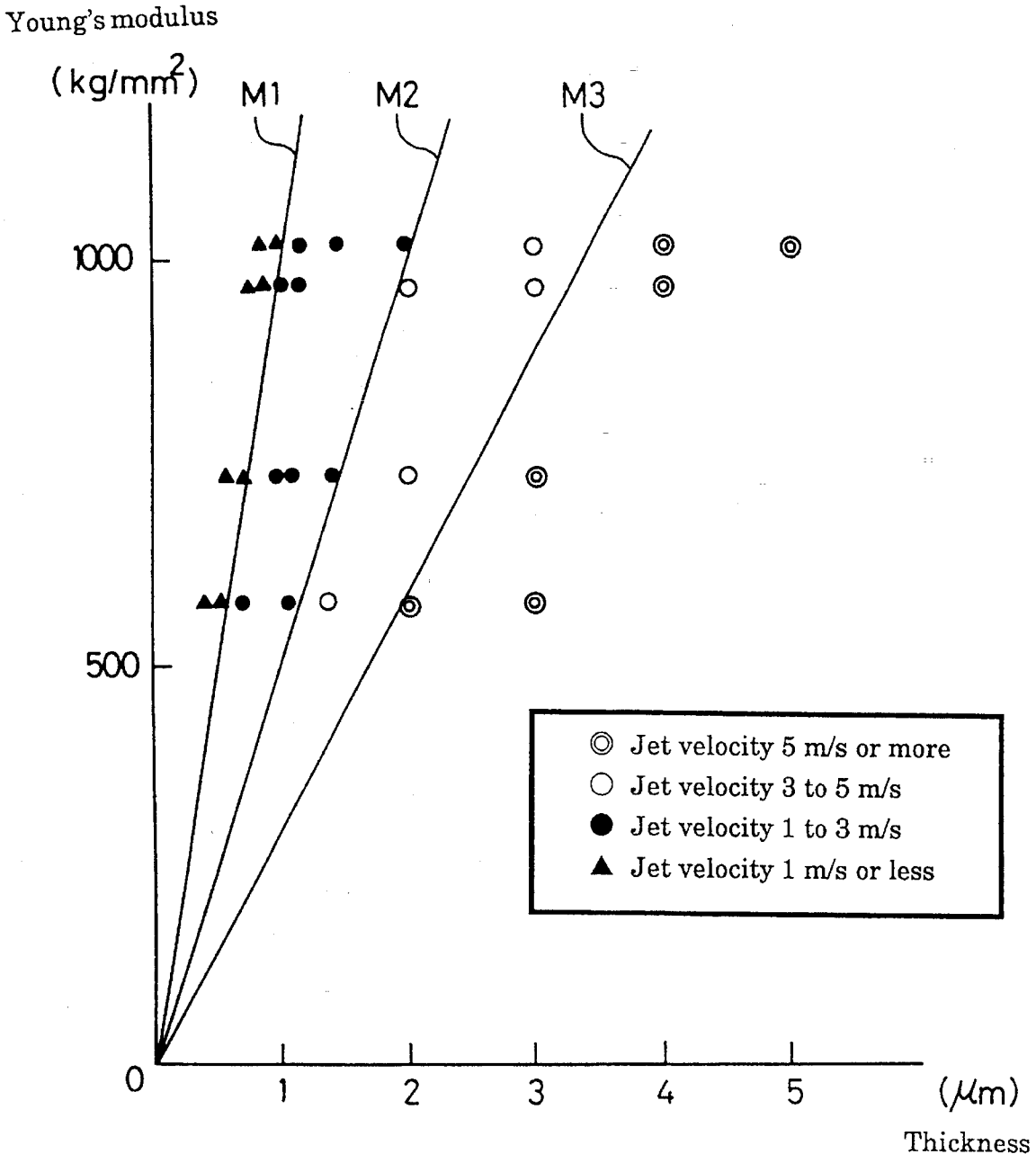
FIG. 2 is a graph showing the relationship between Young's modulus of the adhesive agent, which is used for the adherence between the piezoelectric ceramic plate and the nozzle plate, and the thickness of the adhesive layer in the preferred embodiment.

As is apparent from FIG. 2, the jet velocity of the ink droplet is above 5 m/s in a lower area of the line M3, 3 to 5 m/s in an area between the lines M3 and M2, 1 to 3 m/s in an area between the lines M2 and M1, and 1 m/s or less in an upper area of the line M1. The inclination of each of the lines M1, M2 and M3 corresponds to a value obtained by dividing the Young's modulus of the adhesive agent 33 by the thickness of the adhesive agent 33, and these values thereof are $1\times10^6$ kg/mm$^3$, $5\times10^5$ kg/mm$^3$, $3\times10^5$ kg/mm$^3$, respectively. Accordingly, if the value obtained by dividing the Young's modulus of the adhesive agent by 33 the thickness of the adhesive agent 33 is below $1\times10^6$ kg/mm$^3$, preferably $5\times10^5$ kg/mm$^3$, and more preferably $3\times10^5$ kg/mm$^3$, the ink droplet jetting can be stably performed.

As described above, the material and thickness of the adhesive agent are selected so that the value obtained by dividing Young's modulus of the adhesive agent 33 for adhesively attaching the nozzle plate 31 to the end surfaces of the piezoelectric ceramic plate 2 and the cover plate 3 by the thickness of the adhesive agent 33 is set to $1\times10^6$ kg/mm$^3$ or less, preferably $5\times10^5$ kg/mm$^3$ or less, and more preferably $3\times10^5$ kg/mm$^3$ or less. Therefore, sufficient volume variation of the ink channels 12 can be obtained by the deformation of the side walls 11 due to the piezoelectric thickness shear mode, and the ink droplet jetting can be stably performed.

On the basis of the above experimental result, the ink jet printer head 1 of this embodiment was formed and used as a carriage scanning type of ink droplet jet device to attempt a printing operation. The specification of the ink droplet jet device was as follows: the carriage moving speed was set to 0.635 m/s, and the distance between the nozzle and the surface of a sheet was set to 1.5 mm.

If different materials and adhering processes are used for the adhesive agent 4 and for the adhesive agent 33 when the ink jet printer head 1 is formed, it would cause the manufacturing cost to be heightened and increase manufacturing time. Therefore, in this embodiment, the same material was used and the adherence was performed in the same adhering process. Accordingly, the Young's modulus and thickness are identical between both adhesive agents, and thus the Young's modulus and the thickness must be set so that both of the above experimental results are satisfied. In view of the above, from the experimental results described above, the most preferable relationship between the Young's modulus and thickness is that the value obtained by dividing the Young modulus by the thickness is above $1.2\times10^5$ kg/mm$^3$, and below $3\times10^5$ kg/mm$^3$. Accordingly, in this embodiment, the adhesive agent having a Young's modulus of 730 kg/mm$^2$ was used, and the thickness of the adhesive agent was set to 3 μm. In this case, the value obtained by dividing the Young's modulus by the thickness is equal to $2.4\times10^5$ kg/mm$^3$, and this value satisfies both conditions as described above.

A print sample when the ink jet printer head 1 thus produced was used was evaluated by concentrating the deviation of the impact point of the ink. It was confirmed that excellent printing with little deviation was carried out. It is to be understood that the present invention is not restricted to the particular forms shown in the foregoing embodiment, and various modifications and alterations can be added thereto without departing from the scope of the invention encompassed by the appended claims.

For example, in this embodiment, the adhesive agent from the epoxy group is used. However, an adhesive agent from the acrylic group, phenol group or the like may be used.

What is claimed is:

1. An ink droplet jet device comprising:

a piezoelectric plate having plural grooves formed therein defining ink channels, each of source ink channels having an end, the grooves being delineated by upstanding side walls in the piezoelectric plate, the side walls having upper surfaces;

a cover plate secured to the piezoelectric plate at the upper surfaces of the side walls by an adhesive agent having a Young's modulus and a thickness, wherein a value obtained by dividing the Young's modulus of the adhesive agent by the thickness of the adhesive agent is $5\times10^3$ kg/mm$^3$ or more so that the adhesive agent has an optimal rigidity to maintain a volume variation in the ink channels, due to a piezoelectric effect of the side walls, within a predetermined volume variation amount; and a nozzle plate secured to the piezoelectric plate at the end of the ink channels by a second adhesive agent having a Young's modulus and a thickness, wherein a value obtained by dividing the Young's modulus of the second adhesive agent by the thickness of the second adhesive agent is $1\times10^6$ kg/mm$^3$ or less and greater than zero so that the second adhesive agent has an optimal elasticity to maintain a volume variation in the ink channels, due to a piezoelectric effect of the side walls, within a predetermined volume variation amount.

2. The ink droplet jet device according to claim 1, wherein the value obtained by dividing the Young's modulus of the adhesive agent by the thickness of the adhesive agent is $5\times10^4$ kg/mm$^3$ or more.

3. The ink droplet jet device according to claim 1, wherein the value obtained by dividing the Young's modulus of the adhesive agent by the thickness of the adhesive agent is $1.2\times10^5$ kg/mm$^3$ or more.

4. The ink droplet jet device according to claim 1, wherein the value obtained by dividing the Young's modulus of the second adhesive agent by the thickness of the second adhesive agent is $5\times10^5$ kg/mm$^3$ or less and greater than zero.

5. The ink droplet jet device according to claim 1, wherein the value obtained by dividing the Young's modulus of the second adhesive agent by the thickness of the second adhesive agent is $3\times10^5$ kg/mm$^3$ or less and greater than zero.

6. The ink droplet jet device according to claim 1, wherein the adhesive agent between the piezoelectric plate and the cover plate and the second adhesive agent between the piezoelectric plate and the nozzle plate are the same.

7. The ink droplet jet device according to claim 1, wherein the adhesive agent between the piezoelectric plate and the cover plate and the second adhesive agent between the piezoelectric plate and the nozzle plate are epoxies.

8. The ink droplet jet device according to claim 1, wherein the adhesive agent between the piezoelectric plate and the cover plate and the second adhesive agent between the piezoelectric plate and the nozzle plate are selected from the group consisting of the epoxy group, the acrylic group, and the phenol group.

9. The ink droplet jet device according to claim 1, wherein the adhesive agent is an epoxy.

10. The ink droplet jet device according to claim 1, wherein the piezoelectric plate is made of ceramic.

11. An ink droplet jet device comprising:

a piezoelectric plate having plural grooves formed therein defining ink channels, the grooves being delineated by upstanding side walls in the piezoelectric plate, the side walls having upper surfaces; and a nozzle plate secured to the piezoelectric plate at an end of the ink channels by an adhesive agent having a Young's modulus and a thickness, wherein a value obtained by dividing the Young's modulus of the adhesive agent by the thickness of the adhesive agent is $1\times10^6$ kg/mm$^3$ or less and greater than zero so that the adhesive agent has an optimal elasticity to maintain a volume variation in the ink channels, due to a piezoelectric effect of the side walls, within a predetermined volume variation amount.

12. The ink droplet jet device according to claim 11, wherein the value obtained by dividing the Young's modulus of the adhesive agent by the thickness of the adhesive agent is $5\times10^5$ kg/mm$^3$ or less and greater than zero.

13. The ink droplet jet device according to claim 11, wherein the value obtained by dividing the Young's modulus of the adhesive agent by the thickness of the adhesive agent is $3\times10^5$ kg/mm$^3$ or less.

14. The ink droplet jet device according to claim 11, wherein the adhesive agent between the piezoelectric plate and the nozzle plate is selected from the group consisting of the epoxy group, the acrylic group, and the phenol group.

15. The ink droplet jet device according to claim 11, wherein the adhesive agent is an epoxy.

16. The ink droplet jet device according to claim 11, wherein the piezoelectric plate is made of ceramic.

17. An ink droplet jet device comprising:

a piezoelectric ceramic plate having plural grooves formed therein defining ink channels, the grooves being delineated by upstanding side walls in the piezoelectric plate, the side walls having upper surfaces;

a cover plate secured to the piezoelectric plate at the upper surfaces of the side walls by an adhesive agent having a Young's modulus and a thickness; and a nozzle plate secured to the piezoelectric plate at an end of the ink channels by the adhesive agent, wherein a value obtained by dividing the Young's modulus of the adhesive agent by the thickness of the adhesive agent is in a range of $5\times10^3$ kg/mm$^3$ and $1\times10^6$ kg/mm$^3$ so that the adhesive agent has an optimal rigidity and elasticity to maintain a volume variation in the ink channels, due to a piezoelectric effect of the side walls, within a predetermined volume variation amount to ensure stable jetting of ink droplets.

18. The ink droplet jet device according to claim 17, wherein the value obtained by dividing the Young's modulus of the adhesive agent by the thickness of the adhesive agent is in a range of $5\times10^4$ kg/mm$^3$ and $5\times10^5$ kg/mm$^3$.

19. The ink droplet jet device according to claim 17, wherein the value obtained by dividing the Young's modulus of the adhesive agent by the thickness of the adhesive agent is in a range of $1.2\times10^5$ kg/mm$^3$ and $3\times10^5$ kg/mm$^3$.

* * * * *